US009008818B2

(12) United States Patent
Mizuno et al.

(10) Patent No.: US 9,008,818 B2
(45) Date of Patent: Apr. 14, 2015

(54) EMBROIDERY DATA GENERATING DEVICE AND NON-TRANSITORY COMPUTER-READABLE MEDIUM

(71) Applicants: Masahiro Mizuno, Nagoya (JP); Chiyo Koga, Nagoya (JP); Yin Hsuan Huang, Chiayi (TW)

(72) Inventors: Masahiro Mizuno, Nagoya (JP); Chiyo Koga, Nagoya (JP); Yin Hsuan Huang, Chiayi (TW)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/249,789

(22) Filed: Apr. 10, 2014

(65) Prior Publication Data

US 2014/0324210 A1 Oct. 30, 2014

(30) Foreign Application Priority Data

Apr. 26, 2013 (JP) ..... 2013-094013

(51) Int. Cl.
*D05C 5/02* (2006.01)
*D05B 19/12* (2006.01)
*D05B 19/10* (2006.01)

(52) U.S. Cl.
CPC ..... *D05B 19/12* (2013.01); *D05B 19/10* (2013.01)

(58) Field of Classification Search
CPC ..... D05B 19/02; D05B 19/04; D05B 19/06; D05B 19/08; D05B 19/085; D05B 19/10; D05B 19/105; D05B 19/12; D05C 5/00; D05C 5/04
USPC ..... 700/138; 112/470.01, 470.04, 470.06
See application file for complete search history.

(56) References Cited

U.S. PATENT DOCUMENTS

| | | | | |
|---|---|---|---|---|
| 4,919,062 | A * | 4/1990 | Yokoe et al. | 112/470.04 |
| 5,775,240 | A * | 7/1998 | Hara et al. | 112/102.5 |
| 7,493,867 | B2 * | 2/2009 | Asano | 112/470.04 |
| 8,733,260 | B2 * | 5/2014 | Takahata et al. | 112/78 |

FOREIGN PATENT DOCUMENTS

| | | |
|---|---|---|
| JP | A-6-54969 | 3/1994 |

* cited by examiner

*Primary Examiner* — Nathan Durham
(74) *Attorney, Agent, or Firm* — Oliff PLC

(57) ABSTRACT

An embroidery data generating device includes a first storage device, a processor, and memory. The first storage device stores a plurality of stitch data used to sew a unit pattern that includes special stitches causing the sewing workpiece to be locally puckered. The memory is configured to store computer-readable instructions. The computer-readable instructions cause the processor to perform processes that include acquiring an area in which the unit pattern is to be arranged, first identifying a selected unit pattern from among a plurality of the unit patterns, based on the plurality of stitch data stored in the first storage device, arranging the identified unit pattern in the acquired area, and generating embroidery data used to sew, on the sewing workpiece held by an embroidery frame, the unit pattern arranged in the plurality in the area, using the sewing machine, based on the stitch data of the identified unit pattern.

14 Claims, 19 Drawing Sheets

HDD (15)

PROGRAM STORAGE AREA (151)

UNIT PATTERN STORAGE AREA (152)

| ID | STITCH DATA | ATTRIBUTE 1 | 2 | 3 | 4 | 5 |
|---|---|---|---|---|---|---|
| 1 |   | V11 | V12 | V13 | V14 | V15 |
| 2 |   | V21 | V22 | V23 | V24 | V25 |
| 3 |   | V31 | V32 | - | V34 | V35 |
| ⋮ | ⋮ | ⋮ | ⋮ | ⋮ | ⋮ | ⋮ |

RELATIONSHIP STORAGE AREA (153)

OTHER STORAGE AREA (154)

EMBROIDERY DATA GENERATING DEVICE AND NON-TRANSITORY COMPUTER-READABLE MEDIUM

CROSS-REFERENCE TO RELATED APPLICATION

This application claims priority from JP2013-094013, filed on Apr. 26, 2013, the content of which is hereby incorporated herein by reference.

BACKGROUND

The present disclosure relates to an embroidery data generating device that generates embroidery data for performing embroidery sewing by a sewing machine that is capable of performing embroidery sewing, and to a computer-readable medium.

A sewing machine that is capable of embroidery sewing is known. The known sewing machine is provided with two X axis feed motors that respectively feed two embroidery frames. The sewing machine holds a single sewing workpiece using the two embroidery frames and performs the sewing while relaxing the sewing workpiece as appropriate by adjusting a gap between the two embroidery frames. In this manner, the sewing machine can form furrows on the sewing workpiece and thus sew an embroidery pattern having a three-dimensional feel.

SUMMARY

However, in the above-described sewing machine, the structure of the sewing machine and the control of the X axis feed motors are complex.

It is an object of the present disclosure to provide an embroidery data generating device that generates embroidery data that is used to perform embroidery sewing having a three-dimensional feel on a sewing workpiece, without making complex a structure of a sewing machine and control of a motor, and a computer-readable medium.

Embodiments of the broad principles derived herein provide an embroidery data generating device including a first storage device, a processor, and a memory. The first storage device stores a plurality of stitch data used to sew a unit pattern on a sewing workpiece, using a sewing machine on which an embroidery frame that holds the sewing workpiece is mounted. The unit pattern includes special stitches that cause the sewing workpiece to be locally puckered. The memory stores computer-readable instructions. The computer-readable instructions cause the processor to perform a process that includes acquiring an area in which the unit pattern is to be arranged. The computer-readable instructions further cause the processor to perform a process that includes first identifying a selected unit pattern from among a plurality of the unit patterns, based on the plurality of stitch data stored in the first storage device. The computer-readable instructions further cause the processor to perform a process that includes arranging, in a plurality, the unit pattern identified by the first identifying in the area acquired by the acquiring. The computer-readable instructions further cause the processor to perform a process that includes generating embroidery data based on the stitch data of the unit pattern identified by the first identifying. The unit pattern is arranged in the plurality in the area by the arranging. The embroidery data is used to sew the unit pattern by the sewing machine on the sewing workpiece held by the embroidery frame.

Embodiments further provide a non-transitory computer-readable medium storing computer-readable instructions that, when executed by a processor of an embroidery data generating device, instruct the processor to perform processes that include acquiring an area in which a unit pattern is to be arranged. The unit pattern is a pattern that is sewn on a sewing workpiece by a sewing machine. The sewing workpiece is held by an embroidery frame mounted on the sewing machine. The unit pattern includes special stitches that cause the sewing workpiece to be locally puckered. The computer-readable instructions further cause the processor to perform a process that includes first identifying a selected unit pattern from among a plurality of the unit patterns, based on a plurality of stitch data stored in a first storage device of the embroidery data generating device. The computer-readable instructions further cause the processor to perform a process that includes arranging, in a plurality, the unit pattern identified by the first identifying in the area acquired by the acquiring. The computer-readable instructions further cause the processor to perform a process that includes generating embroidery data based on the stitch data of the unit pattern identified by the first identifying. The unit pattern is arranged in the plurality in the area by the arranging. The embroidery data is used to sew the unit pattern by the sewing machine on the sewing workpiece.

BRIEF DESCRIPTION OF THE DRAWINGS

Embodiments will be described below in detail with reference to the accompanying drawings in which.

DETAILED DESCRIPTION OF THE EXEMPLARY EMBODIMENTS

Figure 1:
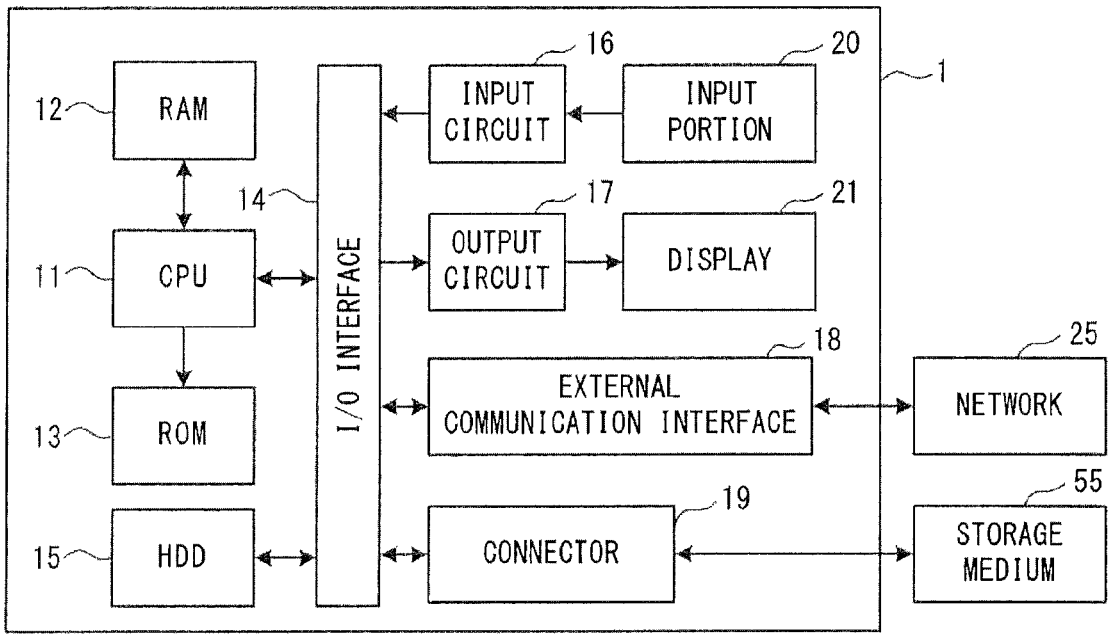
FIG. 1 is a block diagram showing an electrical configuration of an embroidery data generating device 1.

Hereinafter, a present embodiment will be explained with reference to the drawings. Note that the drawings are used for explaining technological features that the present disclosure can utilize. Accordingly, device configurations, flowcharts for various types of processing, and the like that are shown in the drawings are merely explanatory examples and do not serve to restrict the present disclosure to those configurations, flowcharts, and the like, unless otherwise indicated specifically. A configuration of an embroidery data generating device 1 will be explained with reference to FIG. 1. The embroidery data generating device 1 is a device that is capable of generating embroidery data in order to form stitches of an embroidery pattern on a sewing workpiece (a work cloth, for example) that is held by an embroidery frame, using a sewing machine 3 (refer to FIG. 3) that will be described later.

The embroidery data generating device 1 may be a device that is dedicated to generating the embroidery data or may be a general-purpose device such as a personal computer or the like. In the present embodiment, the general-purpose embroidery data generating device 1 is exemplified. As shown in FIG. 1, the embroidery data generating device 1 is provided with a CPU 1, which is a controller that performs control of the embroidery data generating device 1. A RAM 12, a ROM 13 and an input/output (I/O) interface 14 are connected to the CPU 11. Various data, such as calculation results obtained as a result of arithmetic processing by the CPU 11, are temporarily stored in the RAM 12. A BIOS etc. is stored in the ROM 13.

The I/O interface 14 mediates in the transmission and reception of data. A hard disk device (HDD) 15, an input circuit 16, an output circuit 17, an external communication interface 18 and a connector 19 are connected to the I/O interface 14.

An input portion 20, such as a keyboard etc., is connected to the input circuit 16, and a display 21 that is a display device is connected to the output circuit 17. The external communication interface 18 is an interface that allows connection to a network 25. The embroidery data generating device 1 can be connected to an external device via the network 25. A storage medium 55, such as a memory card etc., can be connected to the connector 19. The embroidery data generating device 1 can read data from the storage medium 55 and write data to the storage medium 55 via the connector 19.

Figure 2:
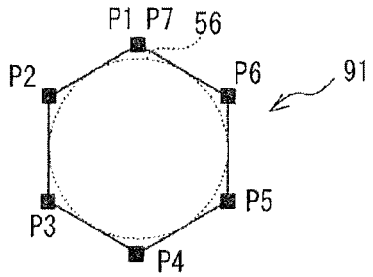
FIG. 2 is an explanatory diagram of storage areas provided in an HDD 15.
Figure 2:
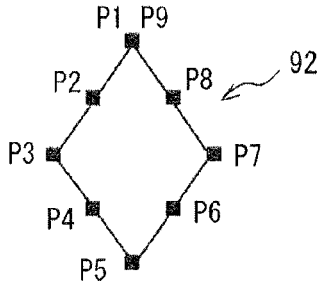
Figure 2:
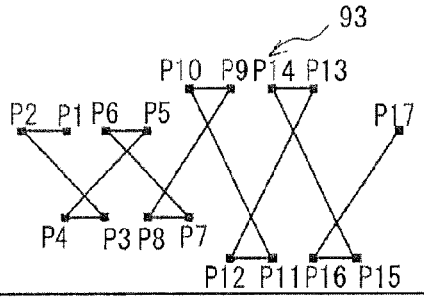

As shown in FIG. 2, the HDD 15 is provided with a plurality of storage areas, including a program storage area 151, a unit pattern storage area 152, a relationship storage area 153, and another storage area 154. The program storage area 151 stores various programs, including a program to perform puckering pattern processing that will be explained later. The unit pattern storage area 152 stores a unit pattern ID in association with stitch data and attributes of a unit pattern. The unit pattern is a pattern including special stitches that cause a relatively soft sewing workpiece to be locally puckered. By sewing the unit pattern on the sewing workpiece, a raised portion is formed on the sewing workpiece. The stitch data is data that is used for the sewing machine 3, on which an embroidery frame 41 (to be described later) is mounted, to sew the unit pattern. The stitch data is data that includes coordinates of needle drop points and a sewing order PN. N is a natural number. The needle drop points and the coordinates will be explained later. The ID is information used to distinguish the unit pattern. Attributes 1 to 5 are, respectively, a size of the unit pattern (Size), a layout angle between the unit patterns (Direction), an amount of displacement of the unit pattern (Offset), a size of the raised portion of the unit pattern (Depth) and an interval between the unit patterns (Interval).

The stitch data for which the ID is 1 is data to sew a hexagonal unit pattern 91 that represents a circular pattern 56. The circular pattern 56 is inscribed in the unit pattern 91. The stitch data of the unit pattern 91 has coordinates of seven needle drop points that are sewn in an order P1 to P7. In the present embodiment, positions of the needle drop points are illustrated using square black symbols. The stitch data for which the ID is 2 is data to sew a diamond-shaped unit pattern 92 that represents a diamond-shaped pattern 57 (refer to FIG. 9). The diamond-shaped pattern 57 matches the unit pattern 92. The stitch data of the unit pattern 92 has coordinates of nine needle drop points that are sewn in an order P1 to P9. The stitch data for which the ID is 3 is data to sew a unit pattern 93 that represents a band-shaped pattern 58 (refer to FIG. 10). A width of the band-shaped pattern 58 matches a width of the unit pattern 93. The width is the length in the direction that is orthogonal to the extending direction (the left-right direction in FIG. 2) of the unit pattern 93. The stitch data of the unit pattern 93 has coordinates of seventeen needle drop points that are sewn in an order P1 to P17. The relationship storage area 153 stores relationships between Depth and a number of repeats. The Depth and the number of repeats will be explained in more detail later. Although not shown in detail, other data is stored in the other storage area 154.

Figure 3:
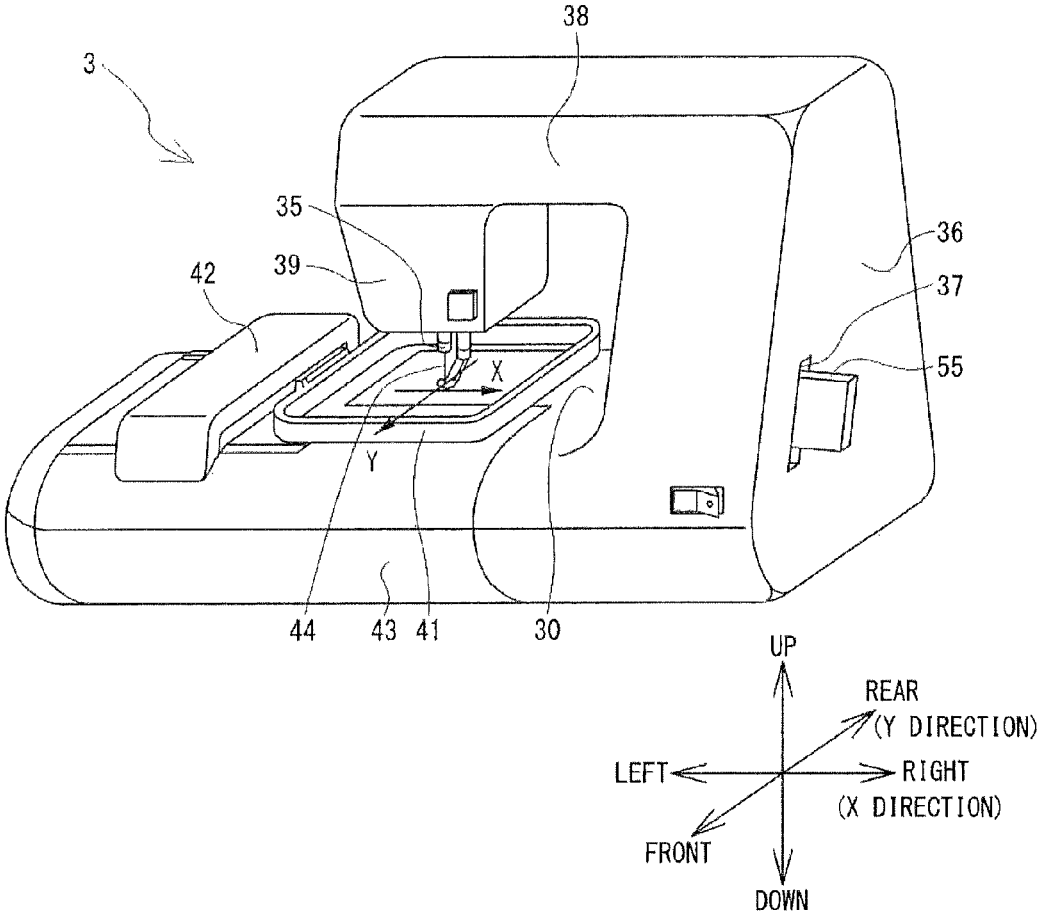
FIG. 3 is an outline diagram of a sewing machine 3.

The sewing machine 3, which is capable of sewing the embroidery pattern based on the embroidery data, will be briefly explained with reference to FIG. 3. As shown in FIG. 3, the sewing machine 3 includes a bed portion 30, a pillar 36, an arm portion 38 and a head portion 39. The bed portion 30 is long in the left-right direction and is a base portion of the sewing machine 3. The pillar 36 extends upward from the right end of the bed portion 30. The arm portion 38 extends to the left from the upper end of the pillar 36 such that the arm portion 38 is facing the bed portion 30. The head portion 39 is a portion that is continuous to the left end of the arm portion 38.

At a time of embroidery sewing, a user of the sewing machine 3 mounts the embroidery frame 41 that holds the sewing workpiece onto a carriage 42 that is placed on the bed portion 30. The embroidery frame 41 is moved to the coordinates of a needle drop point by a Y axis movement mechanism (not shown in the drawings) that is housed in the carriage 42 and an X axis movement mechanism (not shown in the drawings) that is housed in a main body case 43. The coordinates of the needle drop point are represented by an XY coordinate system that is unique to the sewing machine 3. The needle drop point is a point at which a sewing needle 44 that is positioned vertically above a needle hole (not shown in the drawings) pierces the sewing workpiece when a needle bar 35 is caused to move in the downward direction from above the sewing workpiece. In the present embodiment, the X direction is the left-right direction of the sewing machine 3. The X plus direction is the direction from the left to the right. The X minus direction is the direction from the right to the left. The Y direction is the front-rear direction of the sewing machine 3. The Y plus direction is the direction from the rear to the front. The Y minus direction is the direction from the front to the rear. By driving the needle bar 35 (on which the sewing needle 44 is mounted) and a shuttle mechanism (not shown in the drawings) along with the embroidery frame 41 being moved, the embroidery pattern is formed on the sewing workpiece. Note that the Y direction movement mechanism, the X direction movement mechanism and the needle bar 35 etc. are controlled based on embroidery data by a CPU (not shown in the drawings) that is built into the sewing machine 3. Similarly to the stitch data, the embroidery data is data representing coordinates and a sewing order of needle drop points to form stitches of the embroidery pattern.

A connector 37, on which the storage medium 55 can be removably attached, is mounted on a side face of the pillar 36 of the sewing machine 3. For example, the embroidery data generated by the embroidery data generating device 1 is stored in the storage medium 55 via the connector 19. After that, the storage medium 55 is attached to the connector 37 of the sewing machine 3, the stored embroidery data is read out and the embroidery data is stored in the sewing machine 3. Based on the embroidery data read out from the storage medium 55, the CPU of the sewing machine 3 controls a sewing operation of the embroidery pattern by the above-described structural elements. In this manner, the sewing machine 3 can sew the embroidery pattern based on the embroidery data generated by the embroidery data generating device 1.

A puckering pattern will be explained. The puckering pattern is a pattern in which a plurality of unit patterns are arranged inside an area specified by the user. In comparison to a normal embroidery pattern, the puckering pattern has an enhanced decorative effect, with a three-dimensional feel created by raised portions that are formed by special stitches. With the normal embroidery pattern, even when stitches are formed on a relatively soft sewing workpiece, the stitches are set such that puckering does not occur. However, with the puckering pattern, the puckering that occurs when stitches are formed on the relatively soft sewing workpiece is used to enhance the decorative effect of the pattern. In the present embodiment, organdie is used as the sewing workpiece that is suited to sewing the puckering pattern, but another work cloth having a thin cloth thickness may be used. When the sewing workpiece is held by the embroidery frame 41, the sewing workpiece is stretched to an appropriate degree. In this state, even if the puckering pattern is sewn on the sewing workpiece, the raised portions of the puckering pattern are not formed. After the puckering pattern is sewn on the sewing workpiece held by the embroidery frame 41, when the sewing workpiece is removed from the embroidery frame 41, the sewing workpiece changes from the stretched state to a slack state, and the puckering occurs. In this manner, the raised portions of the puckering pattern are formed on the sewing workpiece.

The puckering pattern processing that is performed by the embroidery data generating device 1 of the present embodiment will be explained with reference to FIG. 4 to FIG. 19, using specific examples 1 to 3. The embroidery data generating device 1 of the present embodiment is able to perform both processing to generate the embroidery data of the puckering pattern and processing to generate the embroidery data of the normal embroidery pattern. The puckering pattern processing is started when the processing to generate the embroidery data of the puckering pattern is selected after a graphic to specify an area is selected or drawn. When the CPU 11 detects a start command, the program to execute the puckering pattern processing that is stored in the program storage area 151 of the HDD 15 is read to the RAM 12, and the following processing to execute instructions included in the program is performed. Each of the specific examples 1 to 3 are cases when the embroidery data of the puckering pattern is generated in which a plurality of unit patterns shown in FIG. 2 are arranged in an area inside a contour of a graphic 51 displayed on a screen 50 shown in FIG. 5. As the unit patterns arranged in the area inside the contour of the graphic 51, the unit pattern 91 is selected in the specific example 1, the unit pattern 92 is selected in the specific example 2 and the unit pattern 93 is selected in the specific example 3. In the following explanation, the layout of the unit patterns is set using the XY coordinate system that is unique to the sewing machine 3. Data that is acquired or generated by the puckering pattern processing is stored as applicable in the RAM 12.

Figure 4:
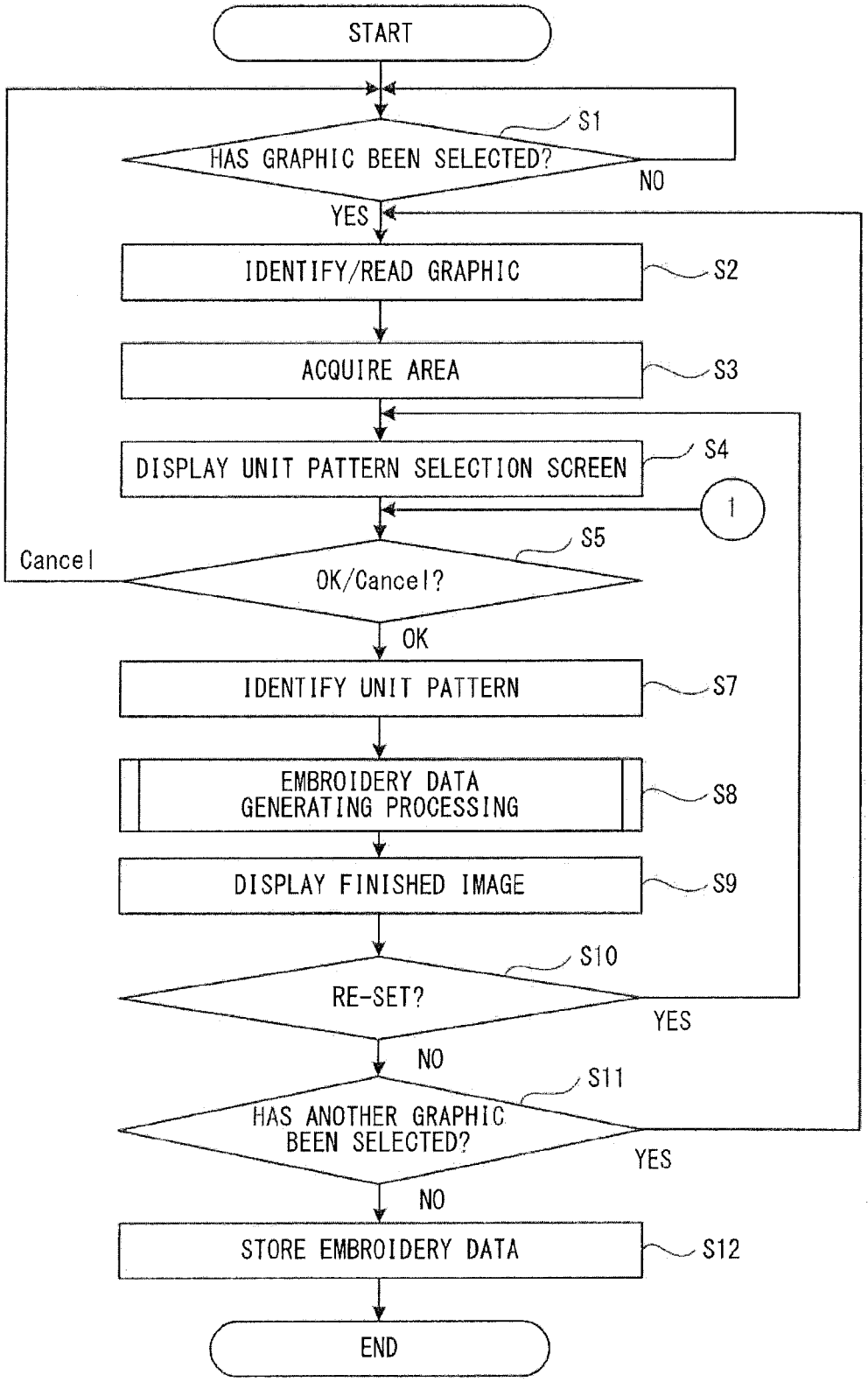
FIG. 4 is a flowchart of puckering pattern processing.

As shown in FIG. 4, first, the CPU 11 stands by until it detects that a graphic has been selected (no at step S1). When the CPU 11 detects that the graphic 51 of the screen 50 shown in FIG. 5 has been selected (yes at step S1), the CPU 11 identifies the selected graphic 51 and reads the shape of the graphic 51 (step S2). Based on the graphic 51 identified in the processing at step S2, the CPU 11 acquires an area to arrange the unit patterns (step S3). The CPU 11 of the present embodiment acquires an area that is enclosed by a contour of the graphic identified in the processing at step S2 as the area in which the unit patterns are to be arranged.

When the CPU 11 detects that a "Puckering" menu has been selected on the screen 50 shown in FIG. 5, the CPU 11 causes a unit pattern selection screen 53 (hereinafter referred to as the screen 53) shown in FIG. 6 to be displayed on the display 21 (step S4). The screen 53 is a screen that is used to select the unit pattern to be arranged in the area acquired at step S3. The screen 53 includes a pattern display field 54, a scrollbar 26, an OK button 59 and a Cancel button 60. The pattern display field 54 displays a shape representing the unit pattern, for each of the plurality of types of unit pattern including the above-described unit patterns 91 to 93, based on the plurality of stitch data stored in the unit pattern storage area 152 of the HDD 15. The circular pattern 56 is a pattern that is represented by the unit pattern 91. The diamond-shaped pattern 57 is a pattern that is represented by the unit pattern 92. The band-shaped pattern 58 is a pattern that is represented by the unit pattern 93. The scroll bar 26 is operated when switching the shape of the unit pattern displayed in the pattern display field 54. The OK button 59 is selected after the desired shape of the unit pattern has been selected from among the shapes of the plurality of types of unit pattern displayed in the pattern display field 54. The Cancel button 60 is selected when cancelling the selection of the shape representing the unit pattern and returning the processing to step S1.

When the CPU 11 detects that the input portion 20 has been operated and the Cancel button 60 has been selected (Cancel at step S5), the CPU 11 returns the processing to step S 1. When the CPU 11 detects that the input portion 20 has been operated and the OK button 59 has been selected (OK at step S5), the CPU 11 identifies the unit pattern selected from among the plurality of types of unit pattern displayed in the pattern display field 54 (step S7). In the specific example 1, the unit pattern 91 is identified. In the specific example 2, the unit pattern 92 is identified. In the specific example 3, the unit pattern 93 is identified. The CPU 11 performs embroidery data generating processing (step S8). In the embroidery data generating processing, the unit pattern identified at step S7 is arranged in a plurality in the area acquired at step S3, and the processing to generate the embroidery data is performed based on the stitch data of the identified unit pattern.

Figure 7:
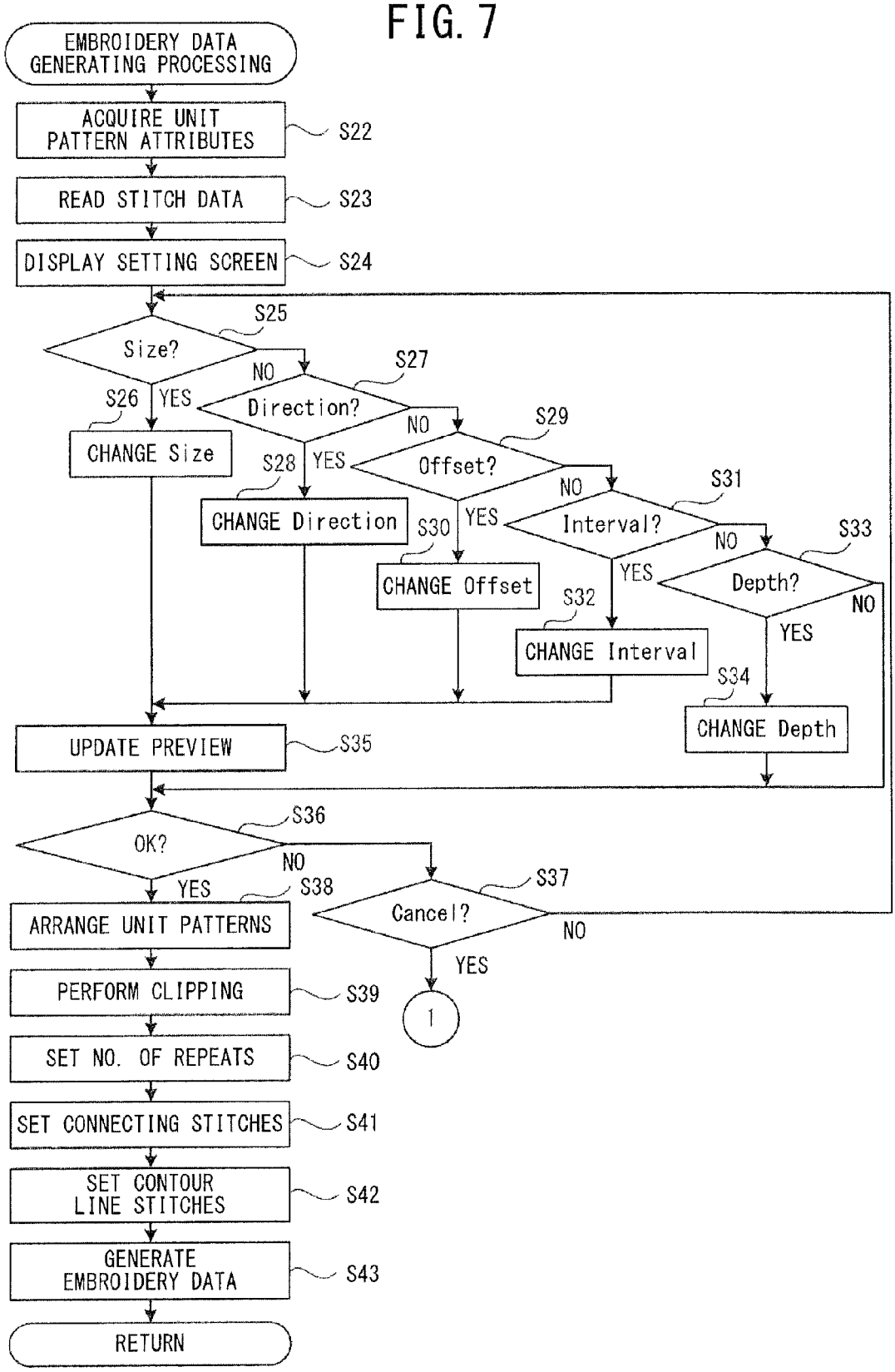
FIG. 7 is a flowchart of embroidery data generating processing that is performed in the puckering pattern processing shown in FIG. 4.

As shown in FIG. 7, in the embroidery data generating processing, the CPU 11 first refers to the unit pattern storage area 152 shown in FIG. 2 and acquires the attributes of the unit pattern identified in the processing at step S7 shown in FIG. 4

(step S22). In the specific example 1, the CPU 11 acquires V11 to V15 as the attributes of the unit pattern 91. In the specific example 2, the CPU 11 acquires V21 to V25 as the attributes of the unit pattern 92. In the specific example 3, the CPU 11 acquires V31, V32, V34 and V35 as the attributes of the unit pattern 93. The CPU 11 refers to the unit pattern storage area 152 and reads the stitch data of the unit pattern identified in the processing at step S7 shown in FIG. 4 (step S23).

Figure 8:
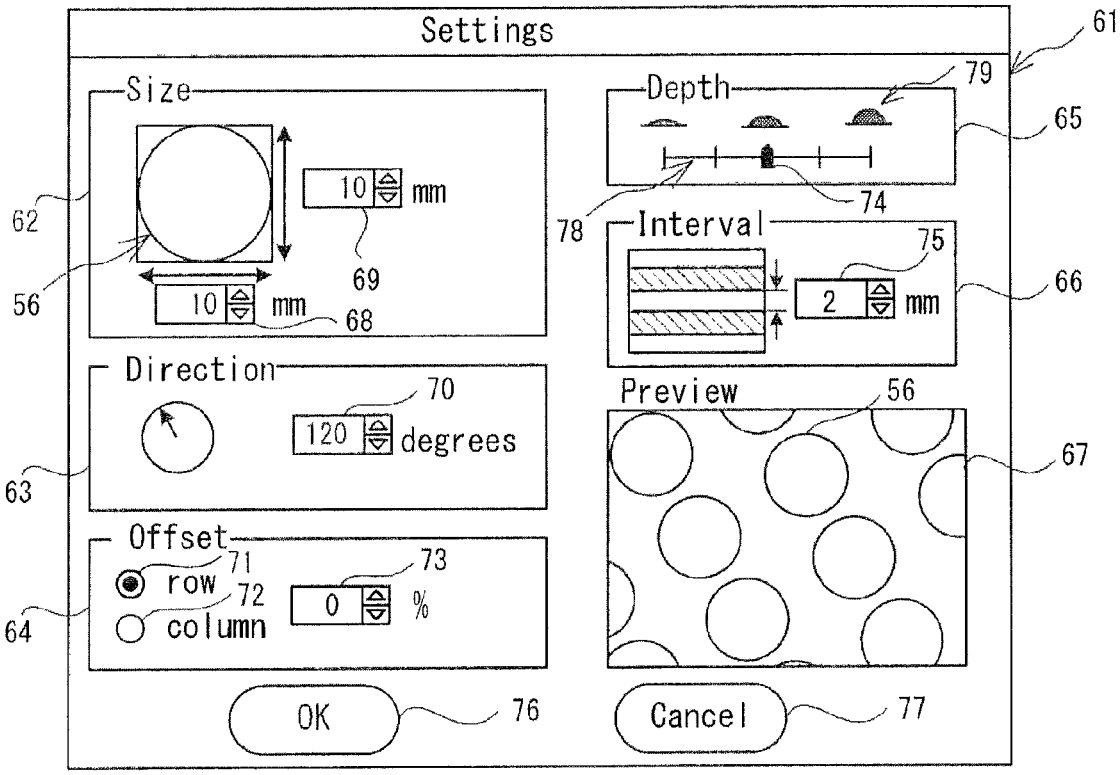
FIG. 8 is an explanatory diagram of a setting screen 61.
Figure 9:
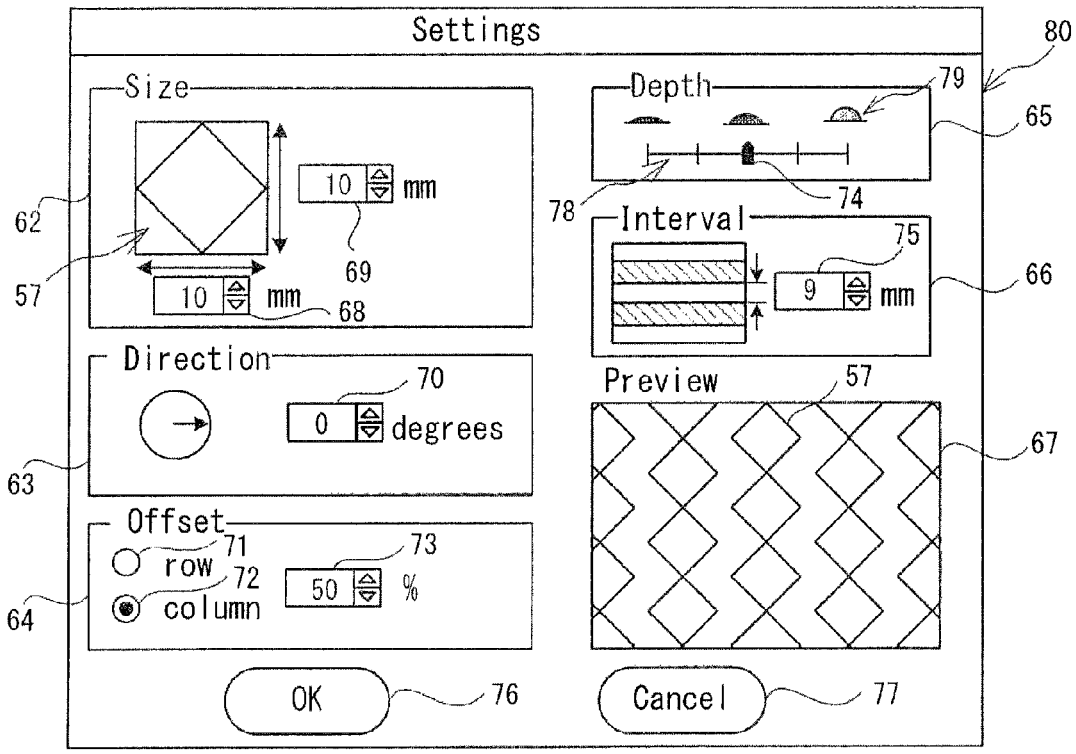
FIG. 9 is an explanatory diagram of a setting screen 80.
Figure 10:
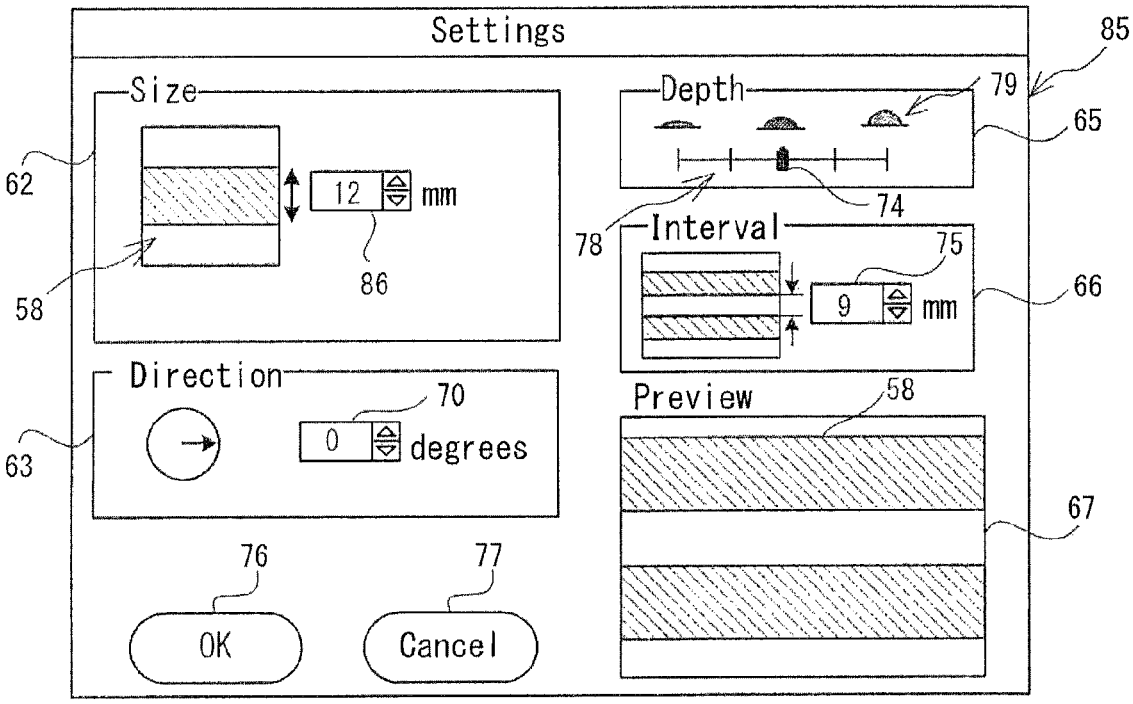
FIG. 10 is an explanatory diagram of a setting screen 85.
Figure 11:
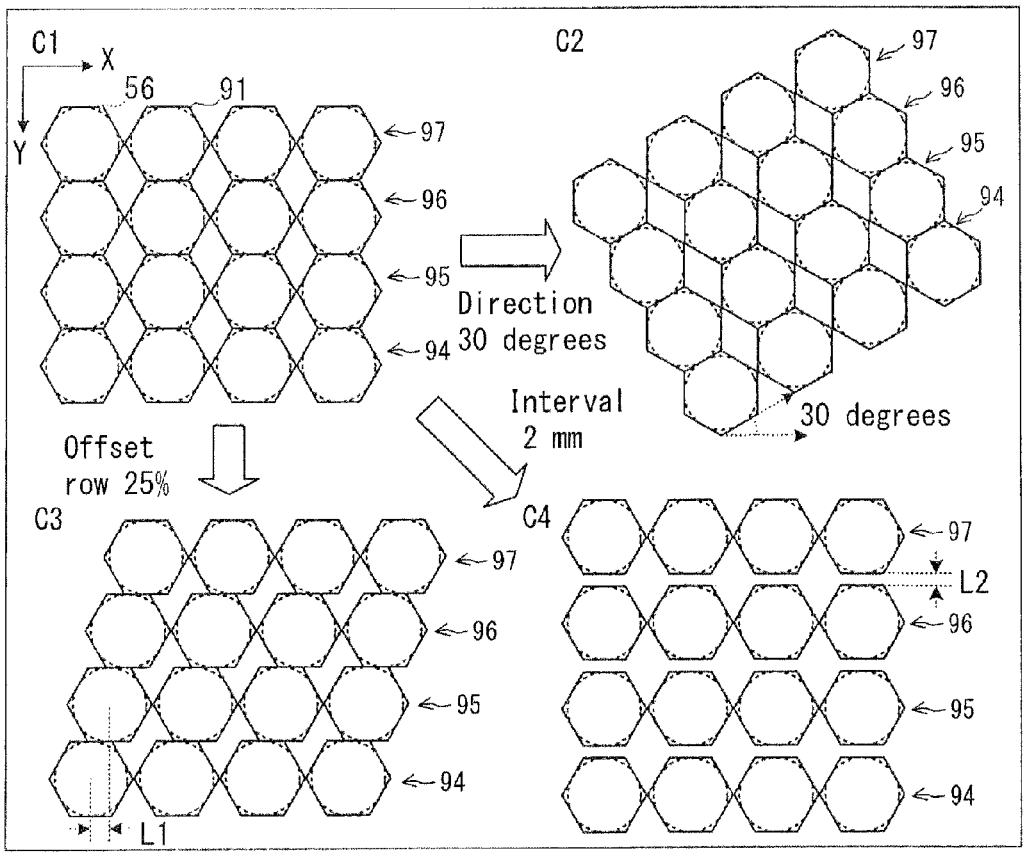
FIG. 11 is an explanatory diagram of a layout for a unit pattern 91 when Direction, Offset or Interval is changed from an initial layout.

Based on the attributes acquired at step S22, the CPU 11 displays a setting screen that corresponds to the identified unit pattern on the display 21 (step S24). In the specific example 1, a setting screen 61 shown in FIG. 8 is displayed on the display 21. In the specific example 2, a setting screen 80 shown in FIG. 9 is displayed on the display 21. In the specific example 3, a setting screen 85 shown in FIG. 10 is displayed on the display 21. Each of the setting screens 61, 80 and 85 is operated when a layout of the unit patterns is changed from an initial layout. The initial layout of the circular patterns 56 is a layout in which the unit patterns 91 that inscribe the circular patterns 56 are arranged without an interval therebetween in a matrix with M1 rows and M2 columns, as shown by C1 in FIGS. 11. M1 and M2 are natural numbers. The initial layout of the unit patterns 92 is a layout in which the unit patterns 92 are arranged without an interval therebetween in a matrix with M1 rows and M2 columns. The initial layout of the unit patterns 93 is a layout in which the unit patterns 93 are arranged at a predetermined interval in the Y direction.

The setting screens 61 and 80 are provided with setting fields 62 to 66, a preview field 67, an OK button 76 and a Cancel button 77. The setting screen 85 is provided with the setting fields 62, 63, 65 and 66, a preview field 67, the OK button 76 and the Cancel button 77. The setting field 62 is a field in which Size can be set, and a method for specifying the size varies depending on the type of the unit pattern. The setting field 62 of the unit patterns 91 and 92 includes input fields 68 and 69. In each of the input fields 68 and 69, it is possible to specify an X direction length and a Y direction length of a minimum rectangle that inscribes the unit pattern. The setting field 62 of the unit pattern 93 includes an input field 86. In the input field 86, it is possible to set the width of the unit pattern 93.

The setting field 63 is a field in which Direction can be set. The setting field 63 includes an input field 70 for inputting a numerical value that represents a rotation amount. The rotation amount is a plus value when the X plus direction is taken as reference and rotation is caused in the counter-clockwise direction. For example, a case is assumed in which 30 is set in the input field 70 on the setting screen 61, and values of the other setting fields are not changed from initial values. In this case, from an initial state shown by C1 in FIG. 11, the plurality of unit patterns 91 are rotated integrally in the counter-clockwise direction by 30 degrees, as shown by C2.

The setting field 64 is a field in which Offset can be set. The setting field 64 is not provided in the setting screen 85 of the unit pattern 93, and the Offset cannot be set with respect to the unit pattern 93. The setting field 64 includes check boxes 71 and 72, and an input field 73. In the input field 73, a ratio of a displacement amount in the offset direction with respect to a reference between unit pattern groups to a size of the unit pattern in the offset direction can be set. The unit pattern group includes the unit patterns of a same row or a same column of the initial layout in which the unit patterns are arranged in the matrix with M1 rows and M2 columns. In the checkboxes 71 and 72, it is possible to set, as the offset direction, a layout direction of the unit patterns included in the unit pattern group for one of the row and the column. For example, on the setting screen 61 shown in FIG. 8, a case is assumed in which the checkbox 71 is selected, 25 is set in the input field 73, and the values of the other setting fields are not changed from the initial values. In this case, from the initial layout shown by C1 in FIG. 11, unit pattern groups 94 to 97 are respectively arranged in positions in which they are moved in the X plus direction by a distance L1 with respect to the unit pattern group that is adjacent in the Y plus direction, as shown by C3. The unit pattern groups 94 to 97 include the unit patterns 91 of the same row. The distance L1 is 25% of the diameter of the circular pattern 56 that is represented by the unit pattern 91.

The setting field 65 is a field in which it is possible to set Depth. The Depth is equivalent to a size of a raised portion that is formed on the sewing workpiece by the special stitches. The setting field 65 includes a bar 74, a scale 78 and images 79. The size of the raised portion, as schematically shown by the images 79, is a relative index comparing the size of the raised portions formed when the unit patterns are sewn on the same sewing workpiece using the same thread. In the present embodiment, one of the five values 1 to 5 on the scale 78 can be selected using the bar 74.

The setting field 66 is a field in which it is possible to set Interval. The setting field 66 includes an input field 75. In the input field 75, it is possible to set an interval between the unit pattern groups. The unit pattern groups of the unit patterns 91 and 92 are the same as the unit pattern groups of the setting field 63. The unit pattern groups of the unit pattern 93 include the unit patterns of the same row. For example, a case is assumed in which, on the setting screen 61, the check box 71 is selected, 2 mm is set in the input field 75, and the value of the other setting fields are not changed from the initial values. In this case, from the initial layout shown by C1 in FIG. 11, each of the unit pattern groups 94 to 97 are arranged at an interval L2 that is 2 mm from the adjacent unit pattern group, as shown by C4.

The preview field 67 displays the layout of the unit patterns in accordance with a setting status of the attributes. When the attribute is changed, an image that is displayed in the preview field 67 is updated as applicable. The left-right direction and the up-down direction of the preview field 67 correspond, respectively, to the X direction and the Y direction. The OK button 76 is selected when the settings of the attributes of the unit pattern are complete and the Cancel button 77 is selected when the settings of the attributes of the unit pattern are to be cancelled.

When the CPU 11 detects that the setting field 62 has been changed (yes at step S25), the CPU 11 sets a post-change numerical value as the Size of the identified unit pattern (step S26). When the CPU 11 detects that the setting field 63 has been changed (no at step S25; yes at step S27), the CPU 11 sets a post-change numerical value as the Direction of the identified unit pattern (step S28). When the CPU 11 detects that the setting field 64 has been changed (no at step S25; no at step S27; yes at step S29), the CPU 11 sets a post-change numerical value as the Offset of the identified unit pattern (step S30). When the CPU 11 detects that the setting field 66 has been changed (no at step S25; no at step S27; no at step S29; yes at step S31), the CPU 11 sets a post-change numerical value as the Interval of the identified unit pattern (step S32). After the processing at step S26, step S28, step S30 or step S32, the CPU 11 updates the image of the preview field 67 on the display 21, based on the changes to the attributes (step S35). When the CPU 11 detects that the setting field 65 has been changed (no at step S25; no at step S27; no at step S29; no at step S31; yes at step S33), the CPU 11 changes the Depth based on the changed numerical value (step S34).

After the processing at step S35 or step S34, when the CPU 11 does not detect that the OK button 76 or the Cancel button 77 has been depressed (no at step S36; no at step S37), the CPU 11 returns the processing to step S25. When the CPU 11 detects that the Cancel button 77 has been depressed (no at step S36; yes at step S37), the CPU 11 returns the processing to step S5 shown in FIG. 4. When the CPU 11 detects that the OK button 76 has been depressed (yes at step S36), based on the attributes of the identified unit pattern and on the stitch data read out at step S23, the CPU 11 arranges, in the XY coordinate system that is unique to the sewing machine 3, a plurality of the identified unit patterns in an area that is sufficiently larger than the size of the area acquired at step S3 shown in FIG. 4 (step S38). The shape of the identified unit pattern is determined in accordance with the stitch data read out at step S23 and the Size set in the setting field 62. The layout of the identified unit patterns is determined in accordance with the attributes of the identified unit pattern. The provisional sewing order PN is set in accordance with predetermined rules for the needle drop points of the plurality of the identified unit pattern. N is a natural number. Layouts of the specific examples 1 to 3 will be explained with reference to FIG. 12 to FIG. 14. The left-right direction and the up-down direction in FIG. 12 to FIG. 14 respectively correspond to the X direction and the Y direction of the XY coordinate system that is unique to the sewing machine 3.

Figure 12:
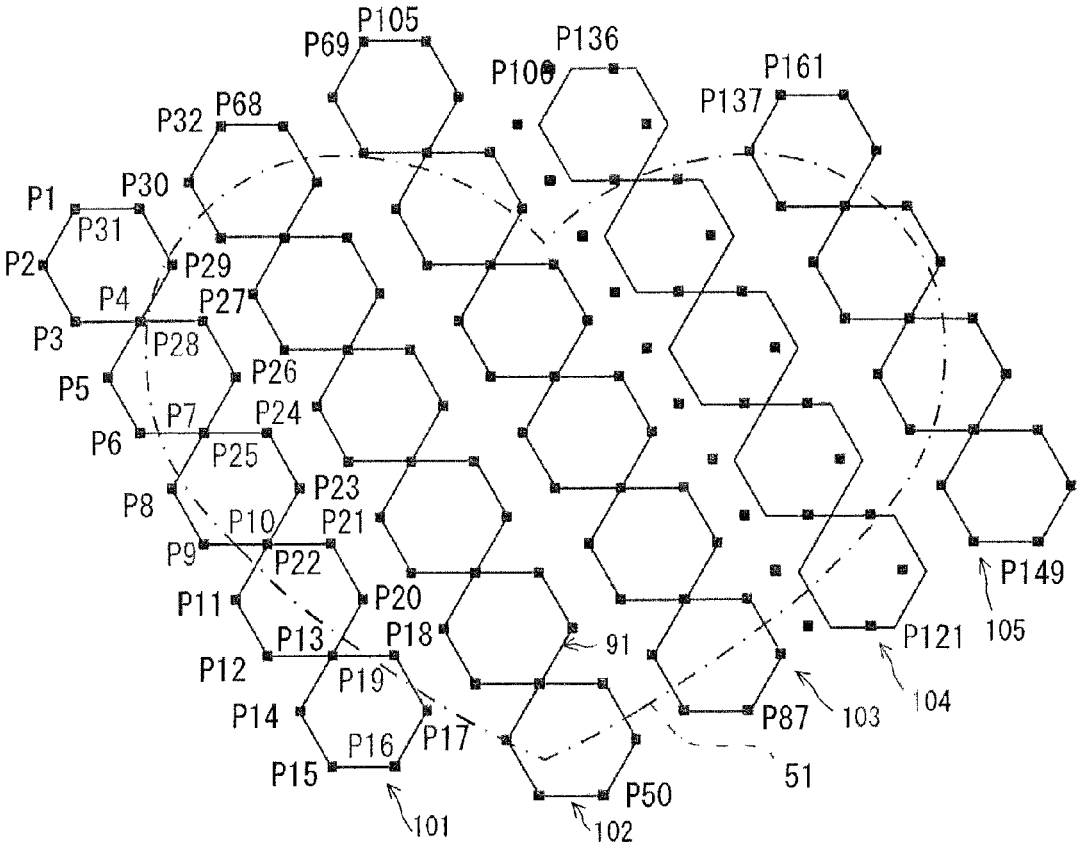
FIG. 12 is a diagram showing a state in which a plurality of the unit patterns 91 are arranged in accordance with settings on the setting screen 61, in an area that is sufficiently larger than a contour line of a graphic 51.

In the specific example 1, based on the attributes shown in FIG. 8, a plurality of the unit patterns 91 are arranged as shown in FIG. 12. In FIG. 12, only the sewing order PN for the needle drop points of a unit pattern group 101 on the leftmost side in FIG. 12 is illustrated in full, and with respect to unit pattern groups 102 to 105, only the sewing order PN for the needle drop points on the top left and the bottom right of FIG. 12 is shown. As shown in FIG. 12, in the unit pattern 91, the sewing order PN is set such that, after N is assigned, from the top to the bottom, to the needle drop points that form the stitches of the left portion of each of the hexagons for each of the unit pattern groups, N is assigned, from the bottom to the top, to the needle drop points that form the stitches of the right portion of each of the hexagons. The sewing order between the unit pattern groups is from the left to the right of FIG. 12.

Figure 13:
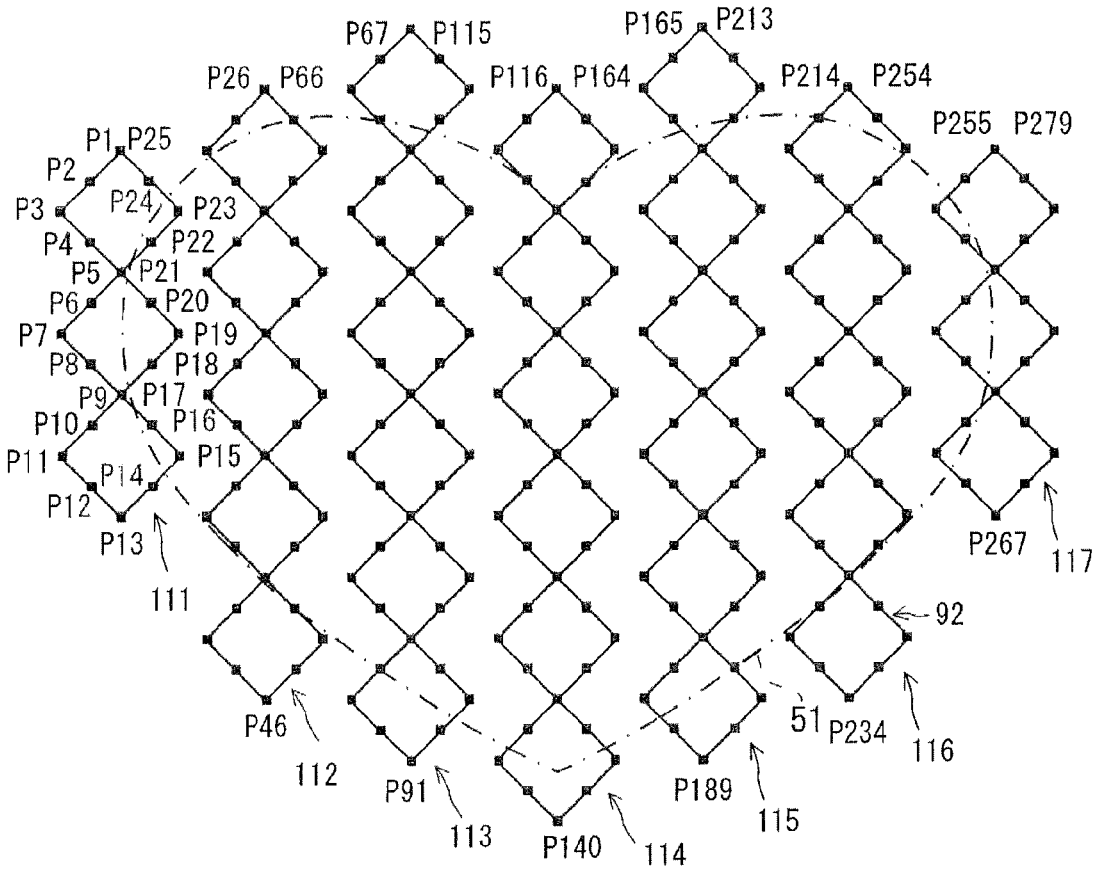
FIG. 13 is a diagram showing a state in which a plurality of unit patterns 92 are arranged in accordance with settings on the setting screen 80, in an area that is sufficiently larger than the contour line of the graphic 51.

In the specific example 2, based on the attributes shown in FIG. 9, the unit patterns 92 are arranged as shown in FIG. 13. In FIG. 13, only the sewing order PN for the needle drop points of a unit pattern group 111 on the leftmost side in FIG. 13 is illustrated in full, and with respect to unit pattern groups 112 to 117, only the sewing order PN for the topmost and the bottommost needle drop points in FIG. 13 is shown. As shown in FIG. 13, in the unit pattern 92, the sewing order PN is set such that, after N is assigned, from the top to the bottom, to the needle drop points that form the stitches of the left portion of each of the diamonds for each of the unit pattern groups, N is assigned, from the bottom to the top, to the needle drop points that form the stitches of the right portion of each of the diamonds. The sewing order between the unit pattern groups is from the left to the right of FIG. 13.

Figure 14:
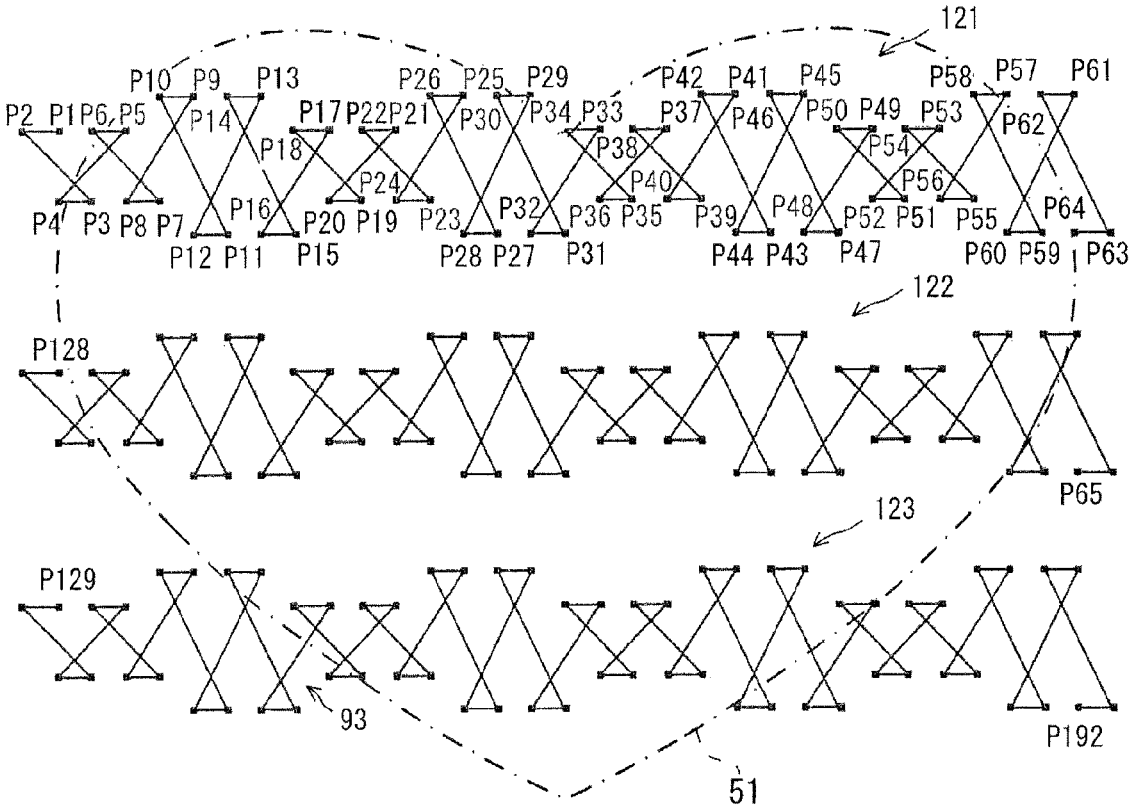
FIG. 14 is a diagram showing a state in which a plurality of unit patterns 93 are arranged in accordance with settings on the setting screen 85, in an area that is sufficiently larger than the contour line of the graphic 51.

In the specific example 3, based on the attributes shown in FIG. 10, the unit patterns 93 are arranged as shown in FIG. 14. In FIG. 14, only the sewing order PN for the needle drop points of a unit pattern group 121 on the topmost side in FIG. 14 is illustrated in full, and with respect to unit pattern groups 122 and 123, only the sewing order PN for the needle drop points at the right end and the left end of each of the unit patterns is shown. As shown in FIG. 14, in the unit pattern 93, the sewing order PN is set such that, taking into account the length of stitches that connect the unit pattern groups, N is assigned from the left to the right in accordance with a sewing order of the unit pattern 93 for the odd-numbered unit pattern groups from the top of FIG. 14. Then, N is assigned from the right to the left of FIG. 14 for the even-numbered unit pattern group from the top of FIG. 14. The sewing order between the unit pattern groups is from the top to the bottom of FIG. 14.

The CPU 11 performs clipping (step S39) on the plurality of unit patterns arranged at step S38, using the graphic 51 identified at step S2. By the processing at step S39, the pattern that is being edited is a pattern in which the unit patterns arranged outside the graphic 51 are cut away. In the specific example 1, by the processing at step S39, a puckering pattern 131 is obtained as represented by an image 181 shown in FIG. 15. In the specific example 2, a puckering pattern 132 is obtained as represented by an image 182 shown in FIG. 16. In the specific example 3, a puckering pattern 133 is obtained as represented by an image 183 shown in FIG. 17. As exemplified in FIG. 18, by the processing at step S39, needle drop points are added as necessary such that stitches included in the same unit pattern group are sewn in ascending order from the smallest value N in the sewing order PN. For example, a needle drop point is added at a point at which a line indicating stitches included in the unit pattern 91 and a contour line of the graphic 51 intersect, as in the case of a needle drop point 171. In another example, where part of the stitch of the unit pattern has been cut away, if the length of the stitch formed is too long, a needle drop point is added to the contour line of the graphic 51 as necessary, such that the length of the stitch formed is within a predetermined range.

Based on the Depth value and on relationships stored in the relationship storage area 153 of the HDD 15, the CPU 11 sets a number of repeats (step S40). The number of repeats is a number of times that the special stitch is sewn in an overlapping manner. However, in the present embodiment, the number of repeats is assumed to be the number of times that the unit pattern is sewn in an overlapping manner. Based on the relationships stored in the relationship storage area 153 of the HDD 15, the CPU 11 of the present embodiment sets the value of the Depth to the number of repeats.

The CPU 11 sets connecting stitches (step S41). The connecting stitch is a stitch that forms a connection between the unit patterns. The connecting stitch of the present embodiment is a stitch along the contour line of the graphic 51. In the specific example 1 shown in FIG. 18, connecting stitches 155 to 158 are set from a unit pattern group 161 to a unit pattern group 165. Based on the graphic 51 identified at step S2 shown in FIG. 4, the CPU 11 sets contour line stitches (step S42). The contour line stitches are stitches that form a contour of the puckering pattern. The contour line stitches of the present embodiment are running stitches sewn around the perimeter on the contour line of the graphic 51.

The CPU 11 generates the embroidery data (step S43). In the processing at step S43, based on the stitch data of the unit pattern identified at step S7, the CPU 11 generates the embroidery data to sew the puckering pattern on the sewing workpiece held in the embroidery frame 41, using the sewing machine 3. The puckering pattern includes the plurality of unit patterns arranged in the area enclosed by the contour line of the graphic 51. The stitches of the puckering pattern of the present embodiment include the stitches representing the unit patterns arranged on the inside of the contour line of the graphic 51 at step S38 and step S39, the connecting stitches set at step S41 and the contour line stitches set at step S42. The sewing order of each of the stitches is set such that the puckering pattern is sewn in the following manner. The sewing is started from the leftmost unit pattern group and each of the unit pattern groups is sewn in order from the left to the right. After a K-th unit pattern group in the sewing order is sewn by the number of repeats set at step S40, a connecting stitch that connects the K-th unit pattern group and a (K+1)-th unit pattern group is sewn. Then, the (K+1)-th unit pattern group is sewn by the number of repeats set at step S40. After the sewing of the last unit pattern group in the sewing order is complete, the contour stitches are sewn around the perimeter on the contour line of the graphic 51. The CPU 11 ends the embroidery data generating processing and returns the processing to the puckering pattern processing shown in FIG. 4.

Figure 15:
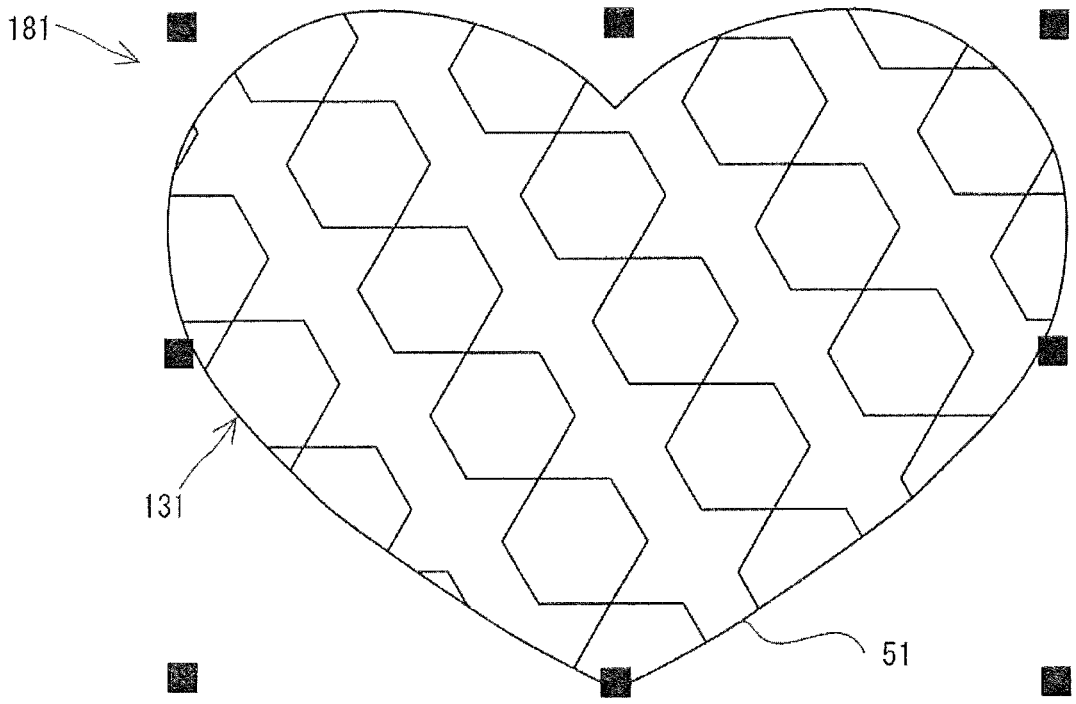
FIG. 15 is a diagram showing a finished embroidery image 181 of a puckering pattern 131.
Figure 16:
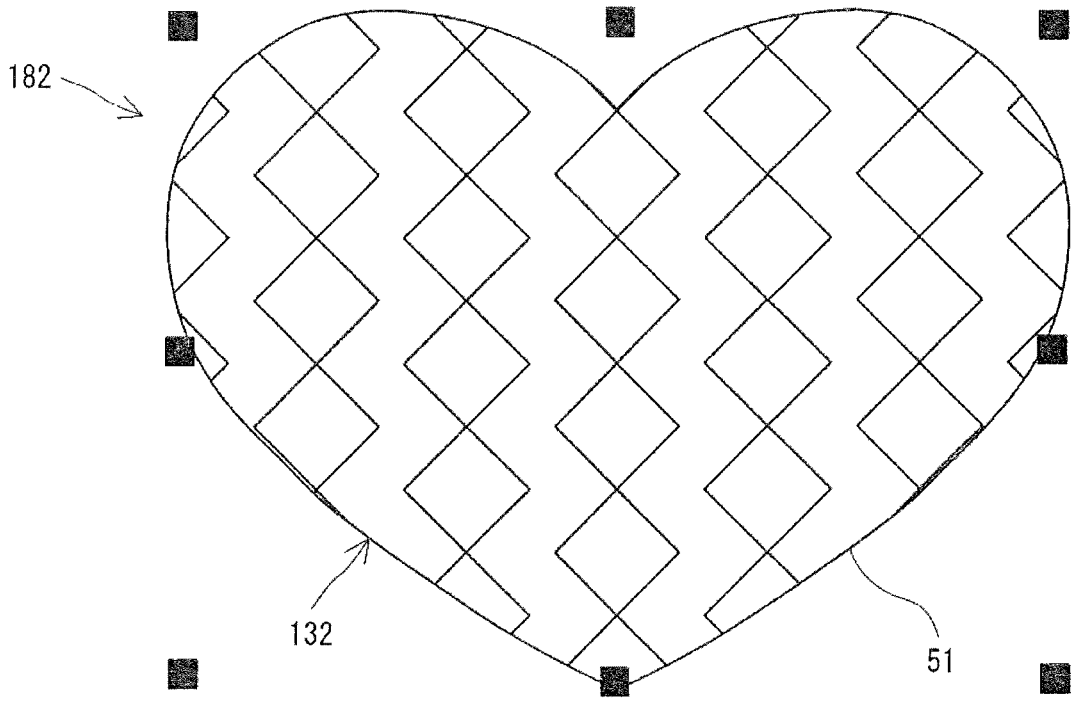
FIG. 16 is a diagram showing a finished embroidery image 182 of a puckering pattern 132.
Figure 17:
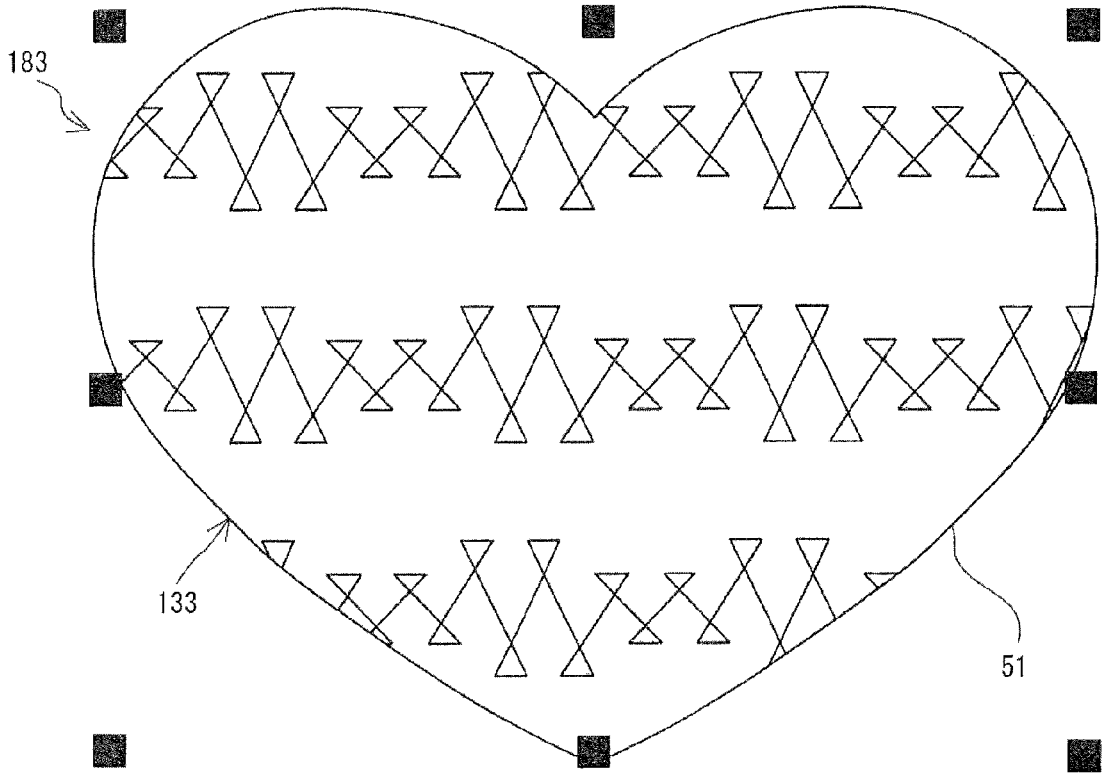
FIG. 17 is a diagram showing a finished embroidery image 183 of a puckering pattern 133.
Figure 18:
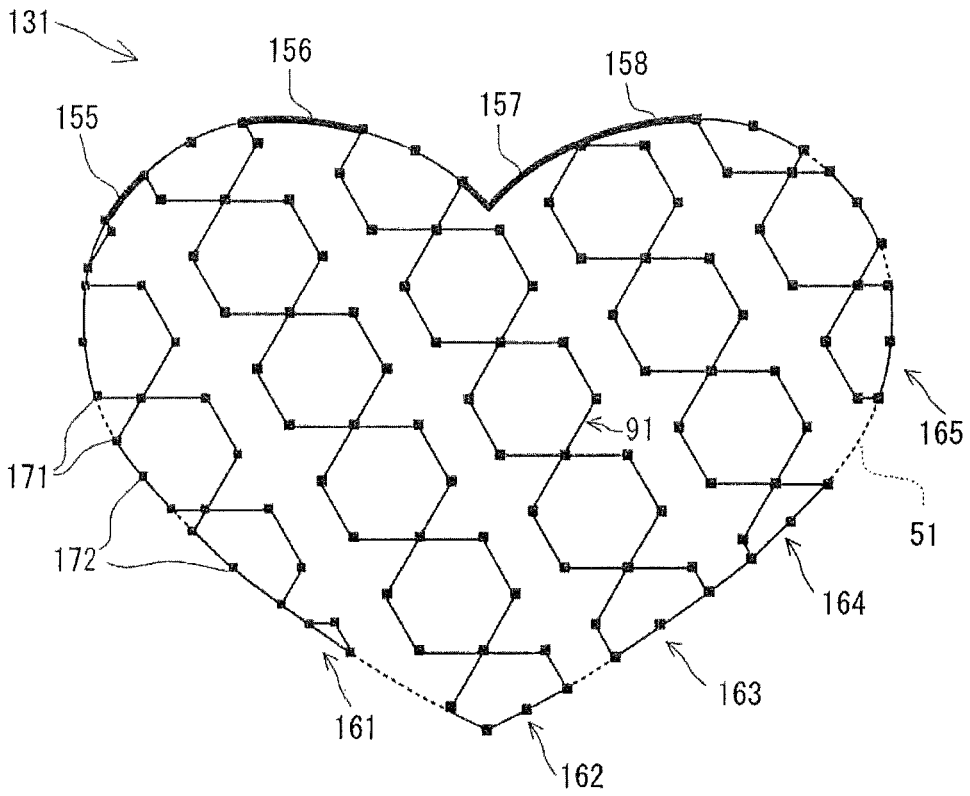
FIG. 18 is an explanatory diagram of a method for setting a sewing order of the puckering pattern 131.

Based on the embroidery data generated at step S8, the CPU 11 displays a finished image on the display 21 (step S9). The finished image is an image that shows the stitches represented by the embroidery data generated in the processing at step S43 shown in FIG. 7 and the graphic 51 identified at step S2. As described above, as the contour line stitches are included in the puckering pattern of the present embodiment, the graphic 51 is shown by the image of the contour line stitches. For the specific examples 1 to 3, by the processing at step S9, the images 181 to 183 shown in FIG. 15 to FIG. 17 are respectively displayed on the display 21. When the CPU 11 detects that the "Puckering" menu of the screen 50 shown in FIG. 5 has been selected (yes at step S10), the CPU 11 returns the processing to step S4 in order to once more select the unit pattern.

Figure 5:
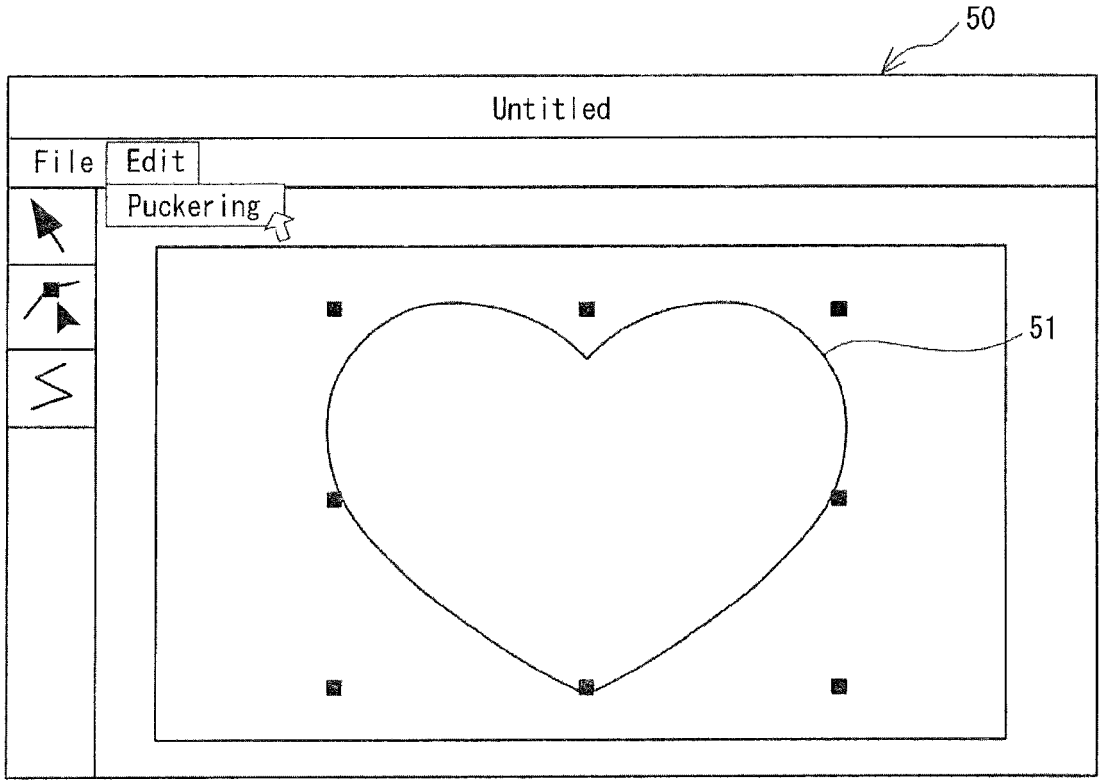
FIG. 5 is an explanatory diagram of a screen 50.
Figure 6:
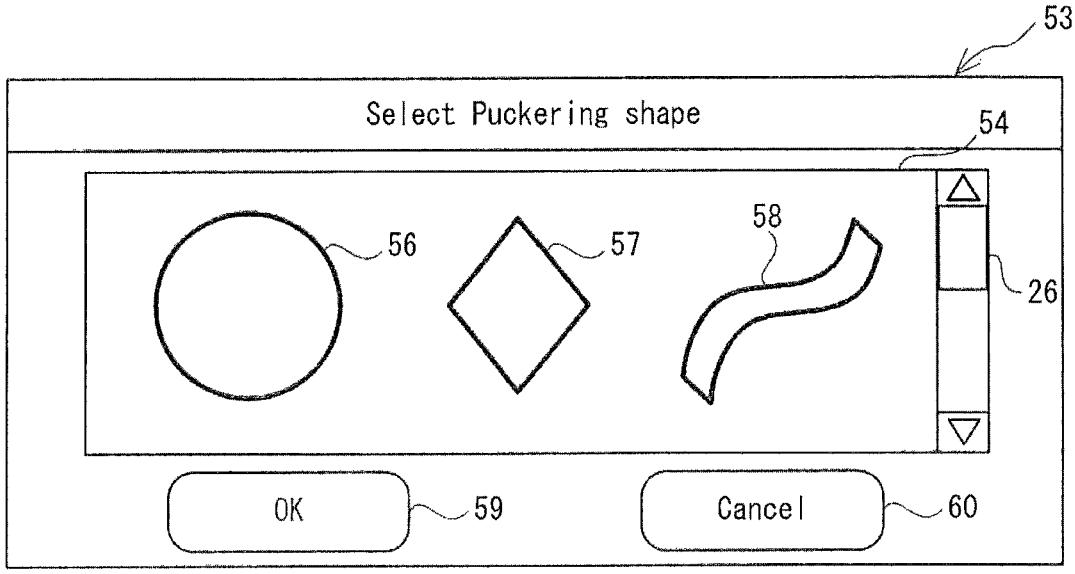
FIG. 6 is an explanatory diagram of a unit pattern selection screen 53.

When the CPU 11 does not detect that the "Puckering" menu of the screen 50 shown in FIG. 5 has been selected (no at step S10), the CPU 11 determines whether it has detected selection of another graphic (step S11). When the CPU 11 detects that another graphic has been selected (yes at step S11), the CPU 11 returns the processing to step S2. When the CPU 11 does not detect that another graphic has been selected (no at step S11), the CPU 11 causes the embroidery data generated at step S43 shown in FIG. 7 to be stored in the HDD 15 (step S12). The CPU 11 then ends the processing.

Figure 19:
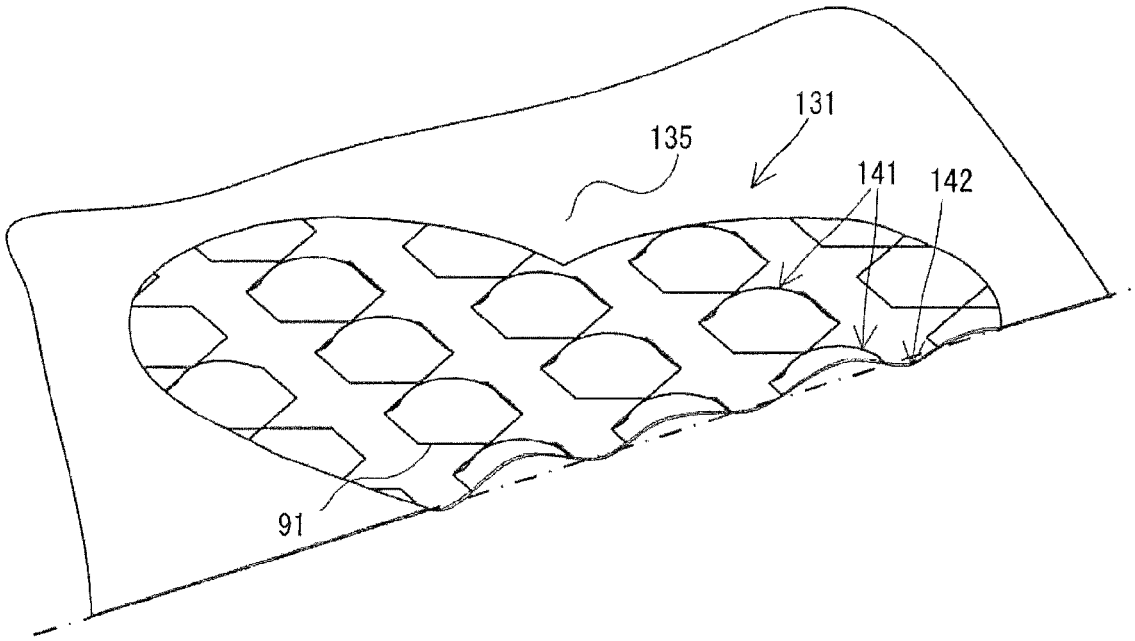
FIG. 19 is a perspective view of a virtual cross-section showing raised portions 141 and depressed portions 142 provided in the puckering pattern 131.

The special stitches of the puckering pattern that is sewn in accordance with the embroidery data generated by the above-described puckering pattern processing cause puckering of the sewing workpiece. As schematically shown in FIG. 19, when the puckering pattern 131 of the specific example 1 has been sewn on a sewing workpiece 135, raised portions 141 that protrude to the upper side of FIG. 19 are formed on the inside of the unit patterns 91. Further, depressed portions 142 that protrude to the lower side of FIG. 19 are formed on the outside of the unit patterns between the adjacent unit patterns. The raised portions 141 and the depressed portions 142 protrude in mutually differing directions. Although not shown in the drawings, when the puckering pattern 132 (refer to FIG. 16) of the specific example 2 has been sewn on the sewing workpiece, raised portions are formed on the inside of the unit patterns 92 and depressed portions are formed on the outside of the unit patterns between the adjacent unit patterns, in a similar manner to that of the specific example 1. When the puckering pattern 133 (refer to FIG. 17) of the specific example 3 has been sewn on the sewing workpiece, band-shaped raised portions are formed in the area in which the unit pattern 93 has been sewn, and depressed portions are formed between two of the adjacent unit patterns. Note that an orientation of the raised portions and the depressed portions may be reversed in some cases.

The embroidery data generating device 1 automatically generates the embroidery data to cause the sewing machine 3 on which the embroidery frame 41 is mounted to sew the puckering pattern that effectively use the puckering on the sewing workpiece by the special stitches. When the sewing machine 3 forms the stitches based on the generated embroidery data, it is sufficient that the embroidery frame 41 be moved appropriately, and it is not necessary for the structure and the control of the sewing machine 3 to become complex, as in known art.

The embroidery data generating device 1 can automatically arrange the plurality of the unit patterns inside the area acquired at step S3 shown in FIG. 4 in accordance with the attributes set in the processing at step S25 to step S32 shown in FIG. 7. By setting the number of times that the special stitches are sewn to overlap each other, the embroidery data generating device 1 can automatically generate the embroidery data that forms the raised portions corresponding to the Depth set in the setting field 65. By selecting or drawing a graphic, the user can specify the area in which the plurality of unit patterns are arranged. By referring to the display 21, the user can verify the stitches that are to be formed on the sewing workpiece in accordance with the embroidery data and verify the selected graphic 51. The embroidery data generating device 1 can store the generated embroidery data in the HDD 15. By sewing the embroidery pattern in accordance with the embroidery data generated by the embroidery data generating device 1, it is possible to form the raised portions 141 inside the plurality of unit patterns 91 and to form the depressed portions 142 on the outside of the unit patterns 91 and between the adjacent unit patterns 91, as shown in FIG. 19.

An embroidery data generating device of the present disclosure is not limited to the above-described embodiment, and various modifications may be applied without departing from the spirit and scope of the present disclosure. For example, any one of the following modifications (A) to (D) may be applied as appropriate.

(A) The structure of the embroidery data generating device may be changed as appropriate. The sewing machine 3 may function as the embroidery data generating device 1. The display device may be any device that is capable of displaying an image. The stitch data and the embroidery data may be stored in the same storage device as each other, or may be stored in different storage devices.

(B) The unit pattern may include stitches other than the special stitches. The structure of the stitch data and the embroidery data and the method for generating the stitch data and the embroidery data may be changed as appropriate. For example, when the embroidery pattern is a pattern sewn using a plurality of colors, the stitch data and the embroidery data may include thread color data. The thread color data is data of colors of the threads forming the stitches. In other example, when the sewing machine has an automatic thread tension adjustment mechanism, the size of the raised portions formed on the sewing workpiece may be adjusted by at least one of the number of repeats and thread tension. The automatic thread tension adjustment mechanism is a mechanism that is configured to adjust the tension of a sewing thread, and is a mechanism that can automatically perform adjustment in accordance with thread tension data. The thread tension data is data indicating the tension of the sewing thread. In this case, the embroidery data may include the thread tension data corresponding to the size of the raised portioned formed on the sewing workpiece. Although the embroidery data includes the data to sew the connecting stitches and the contour line stitches, some or all of the data to sew the connecting stitches and the contour line stitches may be omitted.

(C) The program including the instructions to perform the puckering pattern processing shown in FIG. 4 and the data that is referred to when performing the processing may be stored in a storage device provided in the embroidery data generating device 1 until the embroidery data generating device 1 executes the program. Therefore, the acquisition method and the acquisition path of the program and the data, and the device that stores the program may each be changed, as appropriate. The programs and the data executed by a processor provided in the embroidery data generating device 1 may be received from another device via a cable or wireless communication, and may be stored in a storage device, such as a flash memory. Examples of the other device include a PC and a server that is connected via a network.

(D) Each of the steps of the puckering pattern processing shown in FIG. 4 are not limited to being performed by the CPU 11 and part or all of the processing steps may be performed by another electronic device (an ASIC, for example). Further, each of the steps of the above-described puckering pattern processing may be processed in a dispersed manner by a plurality of electronic devices (a plurality of CPUs, for example). Alternatively, an order of each of the steps of the puckering pattern processing of the above embodiment can be changed, or a step can be omitted or added, as necessary. Furthermore, a case in which, based on instructions from the CPU 11 of the embroidery data generating device 1, an operating system (OS) etc. that operates on the embroidery data generating device 1 performs a part or all of the processing in actuality and achieves the functions of the above-described embodiment through that processing is also included in the scope of the present disclosure. For example, the following modifications shown in (D-1) to (D-4) can be applied as appropriate.

(D-1) The area in which the plurality of unit patterns are arranged need not necessarily be acquired based on a graphic selected by the user. For example, in place of the processing from step S1 to step S3 shown in FIG. 4, the CPU 11 may perform processing to acquire a part or all of a sewable area that is set inside the embroidery frame 41 as the area in which the plurality of unit patterns are arranged.

(D-2) In the embroidery data generating processing shown in FIG. 7, the type of attributes and the number of attributes of the unit pattern that can be set by the user may be changed as appropriate. A number or a density of the unit patterns arranged inside the area can be set as an attribute. The processing to set the attributes may be changed as appropriate, depending on the type and the number of the attributes. In the above-described embodiment, the attributes that can be set differ for each of the unit patterns, but the attributes that can be set may be the same for all of the unit patterns. When default values are used as the attributes of the unit pattern, the user need not necessarily be able to set the attributes of the unit pattern. For example, step S33, step S34 and step S40 shown in FIG. 7 may be omitted as necessary.

(D-3) As long as a method for arranging the unit patterns inside the area acquired at step S3 is established in advance, it may be changed as appropriate. For example, in place of the processing at step S38 and step S39 shown in FIG. 7, the unit patterns may be arranged inside the area acquired at step S3 in accordance with the attributes of the unit pattern. Similarly, the method for generating the embroidery data may be changed as appropriate while taking into account a method for arranging the unit patterns and data that includes the embroidery data etc. For example, the method for setting the sewing order may be changed as appropriate. In another example, in the above-described embodiment, the CPU 11 sets the sewing order such that the sewing is performed for the number of repeats for each of the unit patterns, but the sewing order when sewing the special stitches such that they are overlapped for the number of repeats is not limited to this example. For example, the CPU 11 may set the sewing order such that the special stitches are sewn for the number of repeats for each of the unit patterns.

(D-4) When it is not necessary to verify the finished embroidery image when the sewing is performed based on the generated embroidery data, step S9 shown in FIG. 4 may be omitted. When the CPU 11 outputs the embroidery data generated in accordance with the puckering pattern processing to an external device such as the sewing machine 3, the processing at step S12 may be omitted.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data generating device for use with a sewing machine on which an embroidery frame holding a sewing workpiece is mounted, the embroidery data generating device comprising:

a first storage device storing a plurality of stitch data for sewing a unit pattern on the sewing workpiece, the unit pattern including special stitches causing local puckering of the sewing workpiece;

a processor; and a non-transitory computer-readable memory storing computer-readable instructions that when executed by the processor, perform processes including:

acquiring a first area for arranging the unit pattern on the sewing workpiece;

first identifying a selected unit pattern from among a plurality of the unit patterns in the plurality of stitch data stored in the first storage device;

arranging a plurality of the selected unit pattern identified by the first identification in a second area larger than a size of the first area;

clipping the plurality of arranged unit patterns outside the first area; and generating embroidery data for sewing the plurality of arranged unit patterns arranged in the first area based on the stitch data of the selected unit pattern identified by the first identification.

2. The embroidery data generating device according to claim 1, wherein the instructions further perform a process comprising:

first setting at least one of a size of the unit pattern, a number of the unit patterns, an interval between the unit patterns, and a layout angle between the unit patterns; wherein the arrangement of the plurality of the selected unit pattern identified by the first identification in the second area is performed in accordance with a set value set of the first setting.

3. The embroidery data generating device according to claim 1, wherein the instructions further perform processes comprising:

second setting a size of a raised portion that is formed on the sewing workpiece by sewing the unit pattern; and third setting a number of times of sewing of the special stitches overlapped on top of one another, corresponding to the size of the raised portion set by the second setting; wherein the generation of embroidery data includes generating the embroidery data based on the stitch data and on the number of times of sewing the special stitches overlapped on top of one another set by the third setting.

4. The embroidery data generating device according to claim 1, wherein the instructions further perform a process comprising:

second identifying a graphic representing a contour of the area; wherein the first area is acquired based on the graphic identified by the second identification.

5. The embroidery data generating device according to claim 4, further comprising:

a display device that displays an image; wherein the instructions further perform a process comprising:

displaying, on the display device, an image showing the graphic and stitches represented by the embroidery data generated by the generating.

6. The embroidery data generating device according to claim 1, further comprising:

a second storage device that stores the embroidery data generated by the generating; wherein the instructions further perform a process comprising:

causing the embroidery data generated by the generating to be stored in the second storage device.

7. The embroidery data generating device according to claim 1, wherein the special stitches include stitches that form raised portions inside the plurality of unit patterns arranged by the arranging and form recessed portions that are outside the unit patterns and between the adjacent unit patterns.

8. A non-transitory computer-readable medium storing computer-readable instructions, the instructions, when executed by a processor of an embroidery data generating device for use with a sewing machine on which an embroidery frame holding a sewing workpiece is mounted, performing processes comprising:

acquiring a first area for arranging a unit pattern on the sewing workpiece, the unit pattern being a pattern that is sewn on the sewing workpiece and the unit pattern including special stitches causing local puckering of the sewing workpiece;

first identifying a selected unit pattern from among a plurality of the unit patterns in a plurality of stitch data stored in a first storage device of the embroidery data generating device;

arranging a plurality of the selected unit pattern identified by the first identification in a second area that is larger than a size of the first area;

clipping the plurality of arranged unit patterns outside the first area; and generating embroidery data for sewing the plurality of arranged unit patterns arranged in the first area based on the stitch data of the selected unit pattern identified by the first identification.

9. The non-transitory computer-readable medium according to claim 8, wherein the instructions further perform a process comprising:

first setting at least one of a size of the unit pattern, a number of the unit patterns, an interval between the unit patterns, and a layout angle between the unit patterns; wherein the arrangement of the plurality of the selected unit pattern identified by the first identification in the second area is performed in accordance with a set value set of the first setting.

10. The non-transitory computer-readable medium according to claim 8, wherein the instructions further perform processes comprising:

second setting a size of a raised portion that is formed on the sewing workpiece by sewing the unit pattern; and third setting a number of times of sewing of the special stitches overlapped on top of one another, corresponding to the size of the raised portion set by the second setting; wherein the generation of embroidery data includes generating the embroidery data based on the stitch data and on the number of times of sewing the special stitches overlapped on top of one another set by the third setting.

11. The non-transitory computer-readable medium according to claim 8, wherein the instructions further perform a process comprising:

second identifying a graphic representing a contour of the area; wherein the first area is acquired based on the graphic identified by the second identification.

12. The non-transitory computer-readable medium according to claim 11, wherein the instructions further perform a process comprising:

displaying, on a display device of the embroidery data generating device, an image showing the graphic and stitches represented by the embroidery data generated by the generating.

13. The non-transitory computer-readable medium according to claim 8, further comprising:

causing the embroidery data generated by the generating to be stored in a second storage device of the embroidery data generating device.

14. The non-transitory computer-readable medium according to claim 8, wherein the special stitches include stitches that form raised portions inside the plurality of unit patterns arranged by the arranging and form recessed portions that are outside the unit patterns and between the adjacent unit patterns.

* * * * *